US011738832B1

(12) United States Patent
Dixon

(10) Patent No.: US 11,738,832 B1
(45) Date of Patent: Aug. 29, 2023

(54) WATERSPORT SUPPORT SYSTEM

(71) Applicant: Bill A. Dixon, Howey-in-the-hills, FL (US)

(72) Inventor: Bill A. Dixon, Howey-in-the-hills, FL (US)

( * ) Notice: Subject to any disclaimer, the term of this patent is extended or adjusted under 35 U.S.C. 154(b) by 0 days.

(21) Appl. No.: 18/118,564

(22) Filed: Mar. 7, 2023

(51) Int. Cl.
*B63B 34/63* (2020.01)

(52) U.S. Cl.
CPC ..... *B63B 34/63* (2020.02)

(58) Field of Classification Search
CPC ..... B63B 34/50; B63B 34/52; B63B 34/54; B63B 34/60; B63B 34/63; A63B 21/4009; A63B 69/187; A63B 21/00181; A63B 69/0059
USPC ..... 441/65, 80, 88, 106, 125
See application file for complete search history.

(56) References Cited

U.S. PATENT DOCUMENTS 5,595,136 A * 1/1997 Shinsky ..... B63B 34/60 114/253

FOREIGN PATENT DOCUMENTS

CA 2644932 A1 * 5/2010 ..... A63B 21/00181
WO WO-2011153594 A1 * 12/2011 ..... B63B 35/815

* cited by examiner

*Primary Examiner* — Daniel V Venne
(74) *Attorney, Agent, or Firm* — Jason T. Daniel, Esq.; Daniel Law Offices, P.A.

(57) ABSTRACT

A watersport support system includes a flotation vest having a back surface, a front surface and side surfaces. At least one adjustment belt is positioned horizontally around the main body of the vest. A pair of tethers engage the adjustment belt along both sides of the vest, and a pair of handle gripping devices are removably connected to the end of the pair of tethers. Each of the handle gripping devices includes an elongated strap that terminates into a malleable curved gripper body, and a hand strap is positioned adjacent to each gripper body. As the user squeezes the gripper body and the tow handle, the pulling force from the handle is transferred from the user's arms to the pair of tethers and the adjustment strap that loops around the back of the user's torso. When the user releases the gripper body, the body disengages the handle.

10 Claims, 4 Drawing Sheets

WATERSPORT SUPPORT SYSTEM

TECHNICAL FIELD

The present invention relates generally to watersport accessories, and more particularly to a system for supporting and aiding a user in gripping a tow rope handle and reducing body strains while performing watersports.

BACKGROUND

The statements in this section merely provide background information related to the present disclosure and may not constitute prior art.

Watersport enthusiasts face a unique challenge when practicing their craft. Unlike other events, watersport participants must grip a tow rope handle in order to be towed along the water surface by a boat. Depending on the particular watersport activity (e.g., traditional waterskiing, slalom skiing, knee boarding, and/or wakeboarding), the surface condition of the water, and the skill of the boat driver, the pulling force on the user's arms and shoulders can be quite intense.

Although most skiers experience the greatest forces at the beginning of a run where they are pulled onto the surface of the water by the handle, many other movements such as jumps, turns, twists, bends and the like also impart significant amounts of force onto the user. This battle with the tow rope is often compared to a continuous game of "tug of war" that can quickly tire and sometimes injure participants.

Accordingly, it would be beneficial to provide a watersport support system that can aid a user in coping with the pulling forces of the tow handle by transferring the load across their body and thus eliminating the drawbacks noted above.

SUMMARY OF THE INVENTION

The present invention is directed at a watersport support system. One embodiment of the present invention can include a flotation vest having a back surface, a front surface, and a pair of side surfaces. The vest can include at least one adjustment belt that is positioned horizontally around the main body of the vest. A pair of tethers can engage the belt along the sides of the vest and can extend outward away from the front of the vest. Each of the tethers can include a length adjustment mechanism and a connector along a distal end.

In one embodiment, a pair of handle gripping devices can be removably connected to the pair of tethers via the connectors. Each of the handle gripping devices can include an elongated strap that terminates into a malleable and curvilinear gripper body along a distal end. A hand strap allows a user to grip the outside surface of the gripper body and to impart a squeezing force through the gripper body onto a tow rope positioned along the inside surface of the gripper body.

When the user is wearing the vest and squeezes the tow rope via the gripper bodies, the pulling force from the tow rope is transferred from the user's arms to the pair of tethers and the adjustment strap that is looped around the back of the user's torso. When the user relaxes or releases their grip on the gripper body, the handle separates and the pulling force on the system from the handle ceases.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
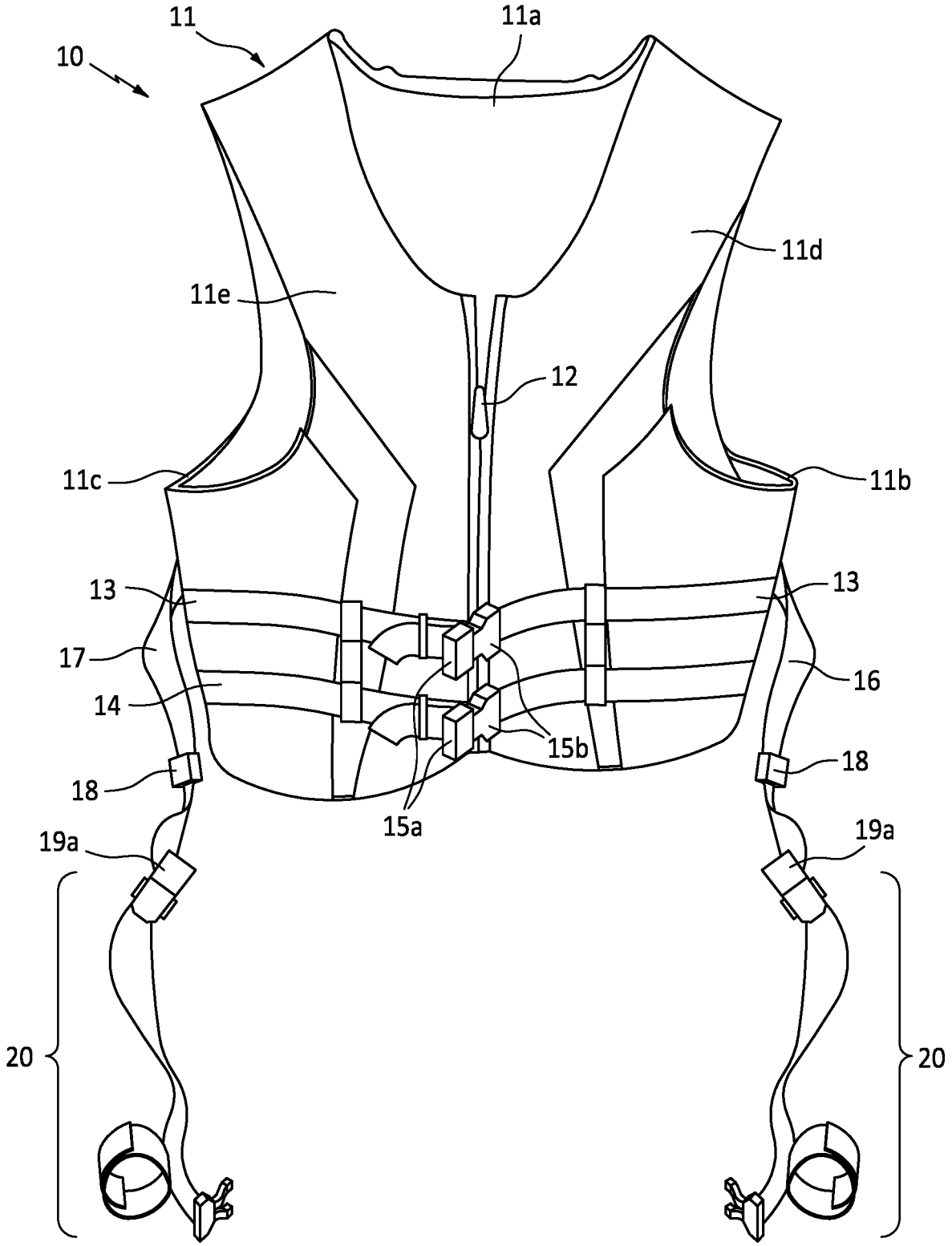
FIG. 1 is a front view of a watersport support system that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Definitions

As described herein, a "unit" means a series of identified physical components which are linked together and/or function together to perform a specified function.

As described throughout this document, the term "about" "approximately" "substantially" and "generally" shall be used interchangeably to describe a feature, shape, or measurement of a component within a tolerance such as, for example, manufacturing tolerances, measurement tolerances or the like.

As described herein, the term "removably secured," and derivatives thereof shall be used to describe a situation wherein two or more objects are joined together in a non-permanent manner so as to allow the same objects to be repeatedly joined and separated.

As described throughout this document, the term "complementary shape," and "complementary dimension," shall be used to describe a shape and size of a component that is identical to, or substantially identical to the shape and size of another identified component within a tolerance such as, for example, manufacturing tolerances, measurement tolerances or the like.

As described herein, the term "connector" includes any number of different elements that work alone or together to repeatedly join two items together in a nonpermanent manner. Several nonlimiting examples of connectors include, but are not limited to, flexible strips of interlocking projections with a slider (i.e., zipper), thread-to-connect, twist-to-connect, and push-to-connect type devices, opposing strips of hook and loop material (e.g., Velcro®), attractively oriented magnetic elements or magnetic and metallic elements, buckles such as side release buckles, clamps, sockets, clips, carabiners, and compression fittings such as T-handle rubber draw latches, hooks, snaps and buttons, for example. Each illustrated connector and complementary connector can be permanently secured to the illustrated portion of the device via a permanent sealer such as glue, adhesive tape, or stitching, for example.

As described herein, the term "resilient memory" is defined as the ability of a component to maintain a particular shape and to attempt to return to the particular shape after being bent, folded, twisted or otherwise manipulated.

FIGS. 1-3B illustrate one embodiment of a watersport support system 10 that is useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

As shown best in FIG. 1, the system 10 can include a flotation vest 11 having a pair of gripping devices 20 connected thereto.

In one embodiment, the flotation vest 11 can include a back panel 11*a*, a pair of side panels 11*b* and 11*c*, and a pair of front panels 11*d* and 11*e*. A zipper 12 can be disposed along the front panels, and any number of adjustment belts 13 and 14 can extend generally horizontally around the main body of the vest. Each of the belts can be aligned by one or more vertical guides, and each belt can include male and female buckles 15*a* and 15*b* along the respective ends. The zipper, belts and buckles can function together to allow a user to tighten the vest securely about their body.

As described herein, the vest can be constructed in any number of different sizes so as to be worn by users of any body style. Moreover, the vest may be constructed from any number of different materials suitable for providing flotation to a wearer in a fresh or saltwater environment. For example, the vest may be constructed from an outer nylon or neoprene fabric that encloses buoyant closed cell foam, for example. Although described above with regard to a particular shape, size or construction material, this is for illustrative purposes only, as many other shapes, sizes and construction materials are also contemplated.

In one embodiment, a pair of grip tethers 16 and 17 can be connected to one of the elongated belts 13 at locations adjacent to the side panels 11*b* and 11*c*. The tethers can preferably be constructed from reinforced nylon straps or other sturdy materials that are suitable for prolonged exposure to water and have excellent tensile strength. The tethers can be permanently connected to the belt 13 via stitches or other such connectors suitable for withstanding high tension without breaking or ripping.

In one embodiment, the length of the tethers can be adjustable via ladder lock buckles 18 or other such components, and connectors 19*a* such as the illustrated male side release buckles can be provided along the distal ends of each of the grip tethers.

Figure 2:
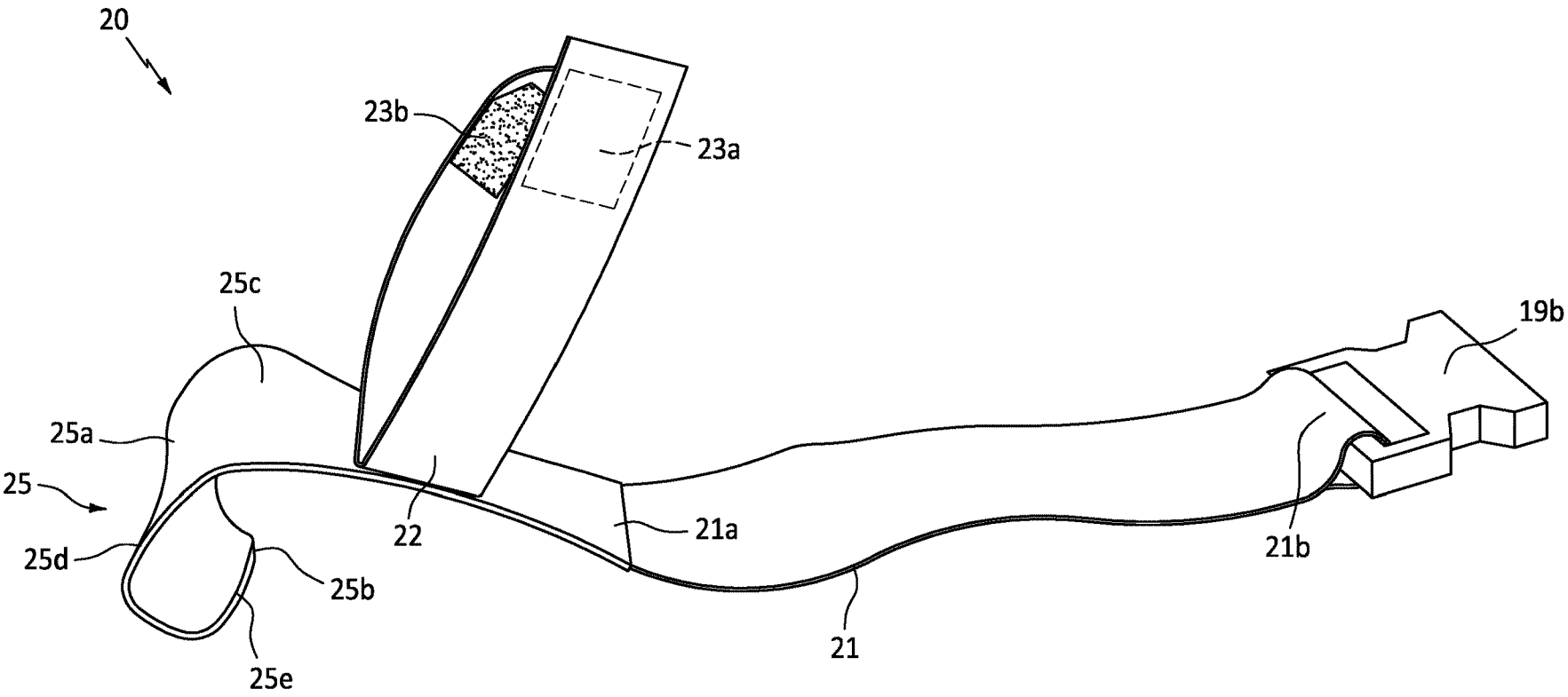
FIG. 2 is a side view of the gripping device of the watersport support system, in accordance with one embodiment of the invention.

FIG. 2 illustrates one embodiment of a handle gripping device 20 for use with the flotation vest 11. As shown, the device 20 can include an elongated strap 21 having a first end 21*a* and a second end 21*b*. The strap can preferably be constructed from the same material as the tethers 16 and 17 described above and can include a connector 19*b* such as the illustrated female side release buckle along one end. Connectors 19*a* and 19*b* can function together to removably secure the gripping device 20 onto one of the grip tethers 17 and 18.

In one embodiment, a hand strap 22 can be provided along the top surface of the strap at a location adjacent to the first end 21*a*. The hand strap can include connectors 23*a* and 23*b* such as strips of hook and loop material, for example, so as to allow a user to fasten the strap about their hand and tighten the same when using the device. Of course, any number of other types of hand engagement devices and/or connectors are also contemplated. Moreover, in one embodiment, the strap can be replaced or augmented with a glove for receiving the user's hand.

In one embodiment, a malleable gripper body 25 can extend outward from the first end of the strap 21*a*. As shown, the gripper body can include an outside surface 25*a*, an inside surface 25*b*, a first end 25*c*, a curving middle portion 25*d*, and a second end 25*e*. The gripper can include a curved half-cylindrical shaped member such that the second end 25*e* is positioned beneath and generally parallel to the first end 25*c* when the gripper body is in the resting position.

In the preferred embodiment, the gripper can be constructed from a thin (e.g., 1-2 mm) piece of malleable and resilient memory plastic such as HDPE, for example, however any number of other malleable construction materials are contemplated. Moreover, as the gripper is designed to engage a tow handle, the curved inside surface of the gripper will preferably be complementary to the outside shape and diameter of a commercially available tow handle.

As will be described below, the inside surface 25*b* of the gripper can function to receive and engage the handle of a tow rope when a user is imparting a squeezing force onto the outside surface 25*a*. As such, when the user releases their grip on the outside surface, the malleable nature of the gripper body will allow the body to straighten as the handle is pulled by the boat, thus ensuring the gripper will immediately separate from the handle before returning to the resting curved position. In this regard, the malleable nature of the gripper body represents a critical safety feature to ensure a user does not continue to be pulled by the handle after letting go.

Figure 3A:
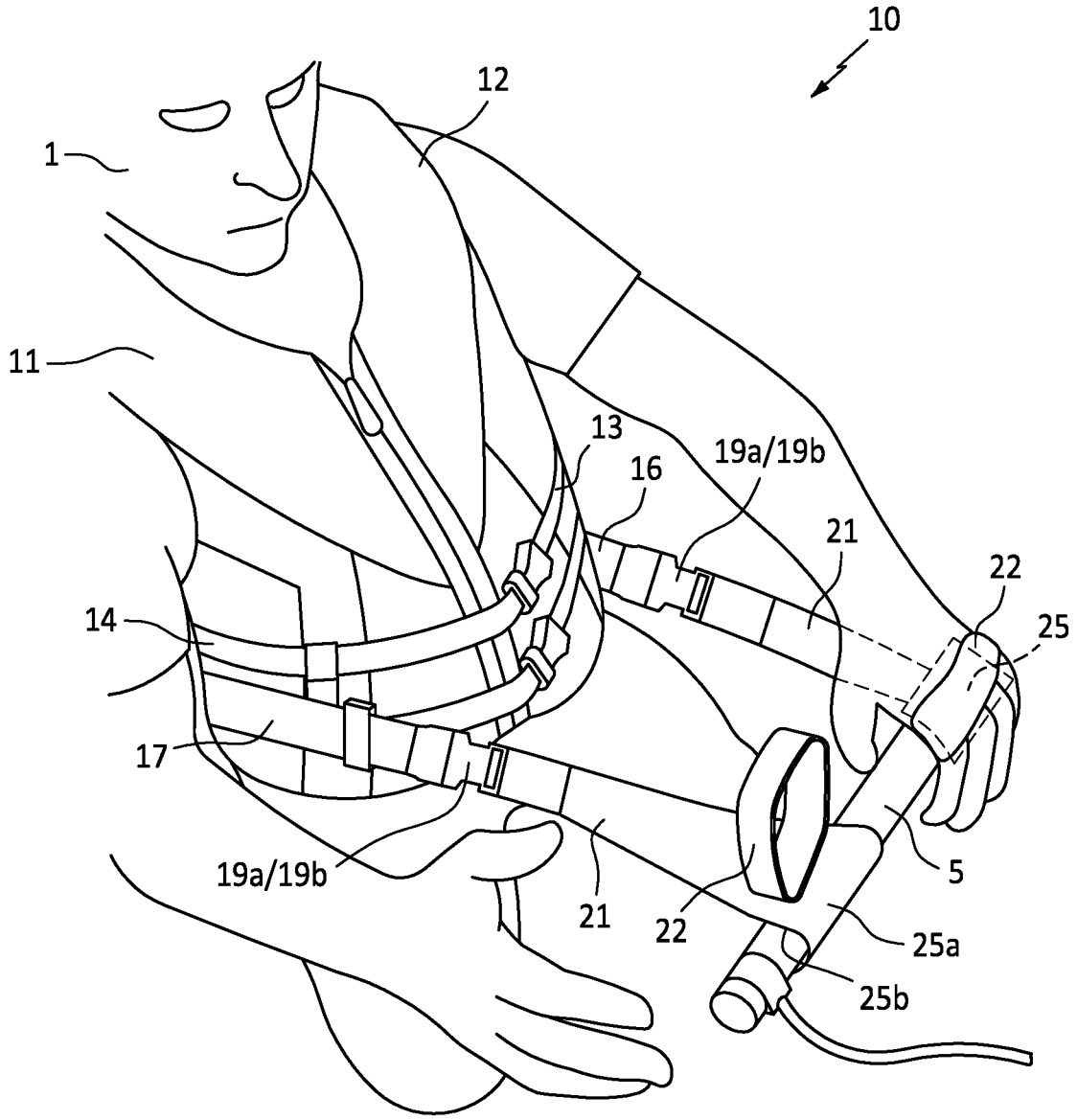
FIG. 3A is a perspective view of the watersport support system in operation, in accordance with one embodiment of the invention.
Figure 3B:
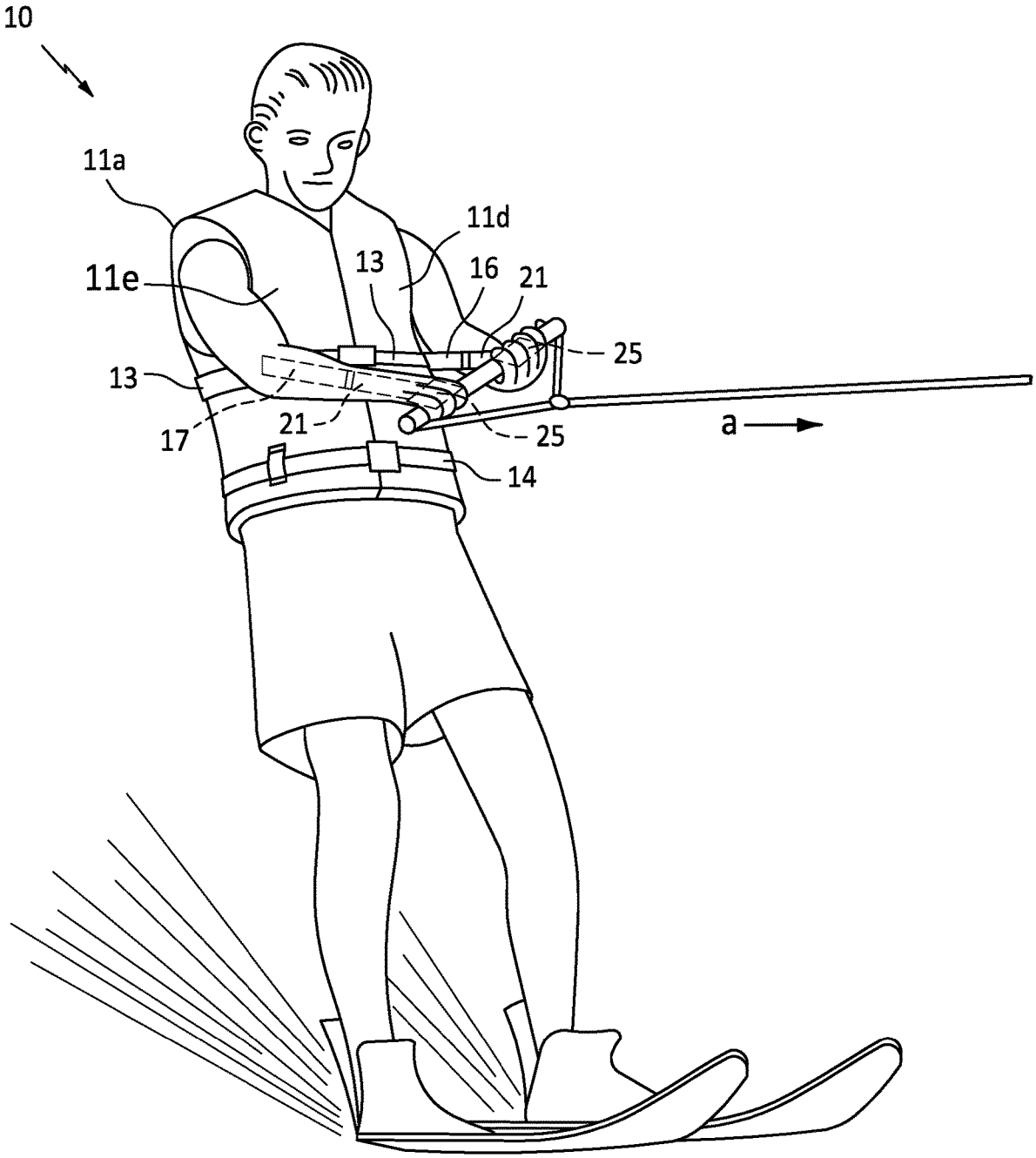
FIG. 3B is another perspective view of the watersport support system in operation, in accordance with one embodiment of the invention.

FIGS. 3A and 3B illustrate one embodiment of system 10 in operation. As shown, a user 1 can secure the vest 11 about their torso in the expected manner via the zipper 12 and adjustment belts 13-14. Next, the user can secure two gripping devices onto the tethers 16 and 17 via connectors 19*a* and 19*b*.

Next, the user can position the curved inside surface 25*b* of the gripper bodies onto a tow handle 5 and adjust the length of the tethers 16-17 and the straps 21 via the adjustment mechanisms 18. When so positioned, the user can secure the hand straps 22 onto their hands via the connectors 23*a* and 23*b*.

When the user is ready to begin the watersport activity, they can apply a squeezing force from their fingers onto the outside surface 25*a* of the gripper bodies. Owing to the malleable nature of each gripper body, the squeezing force will allow the user to securely grip the handle 5 through the gripper body in any manner they would normally do so.

As shown best at FIG. 3B, when the handle 5 is pulled away from the user (see arrow a), their arms can extend until the tether bodies and straps reach the user defined length. At this point, the pulling force from the handle will be transferred from the user's arms onto both sides of the belt 13 via the respective gripper straps 21 and tethers 17-18. This arrangement allows the user to feel little to no resistance/pulling force in their arms, because the pulling force is transferred to the belt 13 that passes around the back of the user's torso.

Finally, when the user is ready to stop being pulled by the handle 5, they can simply release their grip on the gripper body 25. As noted above, because the gripper body is malleable, it will not remain connected to the handle under tension without the user applying the continuous squeezing force onto the same. Therefore, when the user releases or relaxes their grip, the device will immediately separate from the handle. Such a feature represents a critical safety feature to ensure a user does not continue to be pulled by the handle after letting go.

Although described above as including a complete vest 11, other embodiments are contemplated. For example, one embodiment is contemplated wherein the vest is not provided as a part of the system and the proximal ends of the straps 16 and 17 include connectors such as carabiners, for example, that can engage the adjustment belts of any type of life jacket. Such a feature allowing the functionality described herein to be utilized with a user's existing ski vest of other gear.

Another exemplary embodiment contemplates a semi malleable brace about which a belt 13 is positioned. The straps 16 and 17 can engage the belt 13 in the manner described above, and the brace can spread the pulling forces encountered by the user along a greater surface of the users back. Such an embodiment can be used in conjunction with, or independently of the vest.

As to a further description of the manner and use of the present invention, the same should be apparent from the above description. Accordingly, no further discussion relating to the manner of usage and operation will be provided.

As described herein, one or more elements of the device 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the term "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A watersport support system, comprising:

a vest having a back surface, a front surface and a pair of side surfaces;

a pair of tethers that extend outward from the vest;

a first handle gripping device that is configured to engage one of the pair of tethers, said first handle gripping device including a first gripper body that is configured to engage a tow handle; and a second handle gripping device that is configured to engage another one of the pair of tethers, said second handle gripping device including a second gripper body that is configured to engage the tow handle.

2. The system of claim 1, further comprising:

at least one adjustment belt that is connected to the vest.

3. The system of claim 2, wherein the pair of tethers are each connected to the at least one adjustment belt.

4. The system of claim 2, wherein the pair of tethers are each permanently connected to opposite sides of the at least one adjustment belt, and said opposite sides are adjacent to the pair of side surfaces of the vest.

5. The system of claim 1, wherein each of the pair of tethers include an adjustable length.

6. The system of claim 1, wherein the length of each of the pair of tethers is adjustable to be complementary to a length of a user's arm.

7. The system of claim 1, wherein each of the first gripper body and the second gripper body includes an inside surface having a shape that is complementary to a cross dimensional shape of the tow handle.

8. The system of claim 1, wherein each of the first gripper body and the second gripper body is constructed from a resilient memory material.

9. The system of claim 1, wherein each of the first gripping device and the second gripping device include a connector along a proximal end.

10. The system of claim 9, wherein each of the first gripping device and the second gripping device are removably connected.

* * * * *